US010106372B2

(12) United States Patent
Jetter et al.

(10) Patent No.: US 10,106,372 B2
(45) Date of Patent: Oct. 23, 2018

(54) ELEVATOR SYSTEMS AND METHODS FOR OPERATING SAME

(71) Applicant: ThyssenKrupp Elevator AG, Essen (DE)

(72) Inventors: Markus Jetter, Filderstadt (DE); Stefan Gerstenmeyer, Filderstadt (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 15/115,350

(22) PCT Filed: Jan. 29, 2015

(86) PCT No.: PCT/EP2015/000167

§ 371 (c)(1),
(2) Date: Jul. 29, 2016

(87) PCT Pub. No.: WO2015/113764

PCT Pub. Date: Aug. 6, 2015

(65) Prior Publication Data

US 2017/0001829 A1 Jan. 5, 2017

(30) Foreign Application Priority Data

Jan. 31, 2014 (DE) ..... 10 2014 201 804

(51) Int. Cl.
*B66B 1/24* (2006.01)
*B66B 3/00* (2006.01)
*B66B 9/00* (2006.01)

(52) U.S. Cl.
CPC ..... *B66B 1/2408* (2013.01); *B66B 1/2416* (2013.01); *B66B 1/2433* (2013.01); (Continued)

(58) Field of Classification Search
CPC ... B66B 1/2408; B66B 1/2416; B66B 1/2433; B66B 1/2458; B66B 1/2466
(Continued)

(56) References Cited

U.S. PATENT DOCUMENTS 1,939,729 A * 12/1933 Stark ..... B66B 9/00 187/249
1,943,119 A * 1/1934 James ..... B66B 9/10 198/322

(Continued)

FOREIGN PATENT DOCUMENTS

CN 1176932 A 3/1998
CN 1462718 A 12/2003

(Continued)

OTHER PUBLICATIONS

English abstract of EP1616832A.

(Continued)

*Primary Examiner* — David Warren
(74) *Attorney, Agent, or Firm* — thyssenkrupp North America, Inc.

(57) ABSTRACT

Lift systems may include a first shaft unit and a second shaft unit, each of which may include a number of lift shafts. One or more single-car systems and/or multi-car systems may be disposed in the first shaft unit, whereas one or more shaft-changing multi-car systems may be disposed in the second shaft unit. A transporting operation may be carried out from an initial floor to a destination floor wherein a control unit determines whether to utilize one or more cars from the single car systems, the multi-car systems, the shaft-changing multi-car systems, or some combination thereof depending on factors such as the destination floors of the passengers, traffic density, energy demand, and/or availability of cars.

20 Claims, 2 Drawing Sheets

(52) U.S. Cl.
CPC ..... *B66B 1/2458* (2013.01); *B66B 1/2466* (2013.01); *B66B 1/2491* (2013.01); *B66B 3/002* (2013.01); *B66B 9/00* (2013.01); *B66B 9/003* (2013.01); *B66B 2201/103* (2013.01); *B66B 2201/30* (2013.01); *B66B 2201/301* (2013.01); *B66B 2201/304* (2013.01); *B66B 2201/305* (2013.01)

(58) Field of Classification Search
USPC ..... 187/247
See application file for complete search history.

(56) References Cited

U.S. PATENT DOCUMENTS

| | | | | |
|---|---|---|---|---|
| 4,004,654 | A * | 1/1977 | Hamy | B66B 9/003 104/127 |
| 4,821,845 | A * | 4/1989 | DeViaris | B66B 7/021 104/307 |
| 5,601,156 | A * | 2/1997 | McCarthy | B66B 9/00 187/249 |
| 5,651,426 | A * | 7/1997 | Bittar | B66B 1/2458 187/249 |
| 5,752,585 | A * | 5/1998 | Bittar | B66B 1/2458 187/249 |
| 5,758,748 | A * | 6/1998 | Barker | B66B 9/00 187/249 |
| 5,785,153 | A | 7/1998 | Powell et al. | |
| 5,861,586 | A * | 1/1999 | McCarthy | B61B 15/00 187/249 |
| 5,924,524 | A * | 7/1999 | Barker | B66B 1/2458 182/12 |
| 9,598,265 | B1 * | 3/2017 | Jacobs | B66B 9/003 |
| 2003/0217893 | A1 * | 11/2003 | Dunser | B66B 1/2466 187/249 |
| 2005/0189181 | A1 * | 9/2005 | Meyle | B66B 1/2458 187/382 |
| 2006/0016640 | A1 | 1/2006 | Duenser | |
| 2006/0163008 | A1 * | 7/2006 | Godwin | B66B 9/00 187/288 |
| 2016/0075533 | A1 * | 3/2016 | Scomparin | B66B 9/003 187/240 |
| 2016/0304316 | A1 * | 10/2016 | Witczak | B66B 11/0407 |
| 2016/0304317 | A1 * | 10/2016 | Witczak | B66B 11/04 |
| 2017/0001829 | A1 * | 1/2017 | Jetter | B66B 1/2433 |
| 2017/0008729 | A1 * | 1/2017 | Ginsberg | B66B 1/28 |
| 2017/0015524 | A1 * | 1/2017 | Fargo | B66B 9/003 |
| 2017/0057780 | A1 * | 3/2017 | Nguyen | B66B 1/3446 |
| 2017/0057784 | A1 * | 3/2017 | Witczak | B66B 7/02 |
| 2017/0057786 | A1 * | 3/2017 | Witczak | B66B 7/046 |
| 2017/0057790 | A1 * | 3/2017 | Roberts | B66B 11/0273 |
| 2017/0057792 | A1 * | 3/2017 | Dwari | B66B 11/0407 |
| 2017/0066623 | A1 * | 3/2017 | Kuczek | B66B 1/28 |
| 2017/0073183 | A1 * | 3/2017 | Ginsberg | B66B 5/06 |
| 2017/0088395 | A1 * | 3/2017 | Roberts | B66B 5/0031 |
| 2017/0088396 | A1 * | 3/2017 | Fargo | B66B 1/32 |
| 2017/0088398 | A1 * | 3/2017 | Kuczek | B66B 5/044 |
| 2017/0158461 | A1 * | 6/2017 | Roberts | B66B 1/30 |
| 2017/0190544 | A1 * | 7/2017 | Witczak | B66B 1/468 |
| 2017/0233218 | A1 * | 8/2017 | Zheng | B66B 1/2491 187/247 |
| 2017/0240385 | A1 * | 8/2017 | Fargo | B66B 11/0446 |

FOREIGN PATENT DOCUMENTS

| | | | |
|---|---|---|---|
| CN | 1668521 | A | 9/2005 |
| EP | 1526103 | A | 4/2005 |
| EP | 1616832 | A | 1/2006 |
| EP | 1619157 | B | 1/2006 |
| JP | H06321445 | A | 11/1994 |
| JP | H07112875 | A | 5/1995 |
| JP | H10310337 | A | 11/1998 |

OTHER PUBLICATIONS

English abstract of EP1526103A.
International Search Report for PCT/EP2015/000167 dated May 7, 2015 (mailed May 13, 2015).
The Japanese Office Action issued in corresponding application No. 2016-547854, dated May 29, 2018. [English translation not included].

* cited by examiner

ELEVATOR SYSTEMS AND METHODS FOR OPERATING SAME

CROSS REFERENCE TO RELATED APPLICATIONS

This application is a U.S. National Stage Entry of International Patent Application Serial Number PCT/EP2015/000167, filed Jan. 29, 2015, which claims priority to German Patent Application No. DE 10 2014 201 804.8 filed Jan. 31, 2014, the entire contents of both of which are incorporated herein by reference.

FIELD

The present disclosure relates to elevator systems and methods for operating such elevator systems.

BACKGROUND

High rise buildings and buildings with a plurality of storeys require complex elevator systems in order to handle all the transporting operations as effectively as possible. In particular, it can be the case at peak times that multiple users would like to be transported from the ground level of the building to the different storeys of the building. At other peak times, for example, multiple users are to be transported from the different storeys to the ground level.

This necessitates logistically-optimized elevator systems which handle these types of load peaks in the shortest possible time. At the same time, individual users are to be transported as quickly as possible to their destination storey, with no long waiting times. At the same time, on the one hand, a car is to be made available as quickly as possible at an initial storey where an individual user would like to board the elevator. On the other hand, the car which is taken by the user is to reach the corresponding destination storey as quickly as possible without covering an unnecessarily large number of intermediate stops. In addition, a user should have to change cars as few times as possible until he reaches the destination storey. If a user has to change cars, the stipulation of as short a waiting time as possible also applies to the subsequent connecting car.

Elevator systems for such purposes are known. Single-car systems or one-car systems comprise, for example, one car in one elevator shaft. Double-decker car systems comprise two cars in one elevator shaft. In the majority of cases said two cars of a double-decker car system are fixedly connected together and in the majority of cases are not able to be moved independently of one another. Multi-car systems comprise at least two cars in one elevator shaft. Said cars of a multi-car system can be moved independently of one another. These types of multi-car systems with two cars that are moveable independently of one another in one elevator shaft are marketed by the applicant under the designation of "TWIN".

In the majority of cases, every known elevator system has individual advantages, but also individual disadvantages. At the same time, for modern elevator systems it is hardly efficient to use just one single car system. Known car systems are hardly capable any more of handling the requirements for the continuously growing number of storeys in high rise buildings and the associated growth in users. Extensions to these types of known car systems or to the performance thereof in this case give rise to an increased demand for floor area and space and are linked to increased operating, installation and maintenance costs along with a high demand for resources. Extensions to known car systems consequently often prove uneconomic and are not able to meet requirements in building planning.

It is consequently desirable to improve elevator systems to the effect that they are able to cope with the requirements of the continuously growing number of storeys in buildings and high rise buildings along with the increasing loads involved which are provided by users.

DETAILED DESCRIPTION

Figure 1:
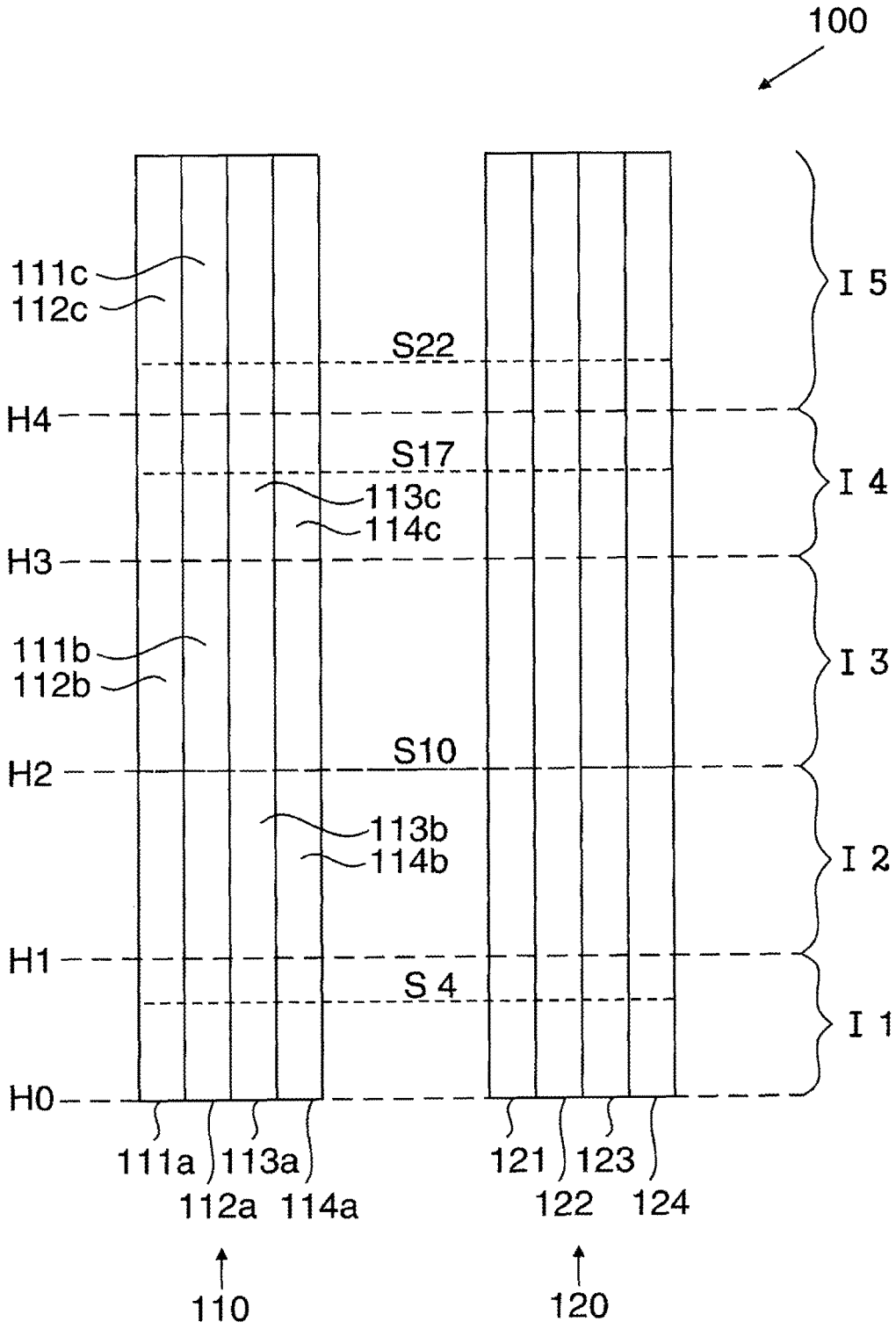
FIG. 1 is a schematic view of an example elevator lift system in a building.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

In some examples, an elevator system may include a first and a second shaft unit. At least one single-car system or one-car system and/or at least one multi-car system may be provided in the first shaft unit. Further, at least one shaft-changing multi-car system may be provided in the second shaft unit.

The first shaft unit can consequently include multiple single-car and/or multi-car systems. In particular, in this case, each single-car system and each multi-car system is provided with its own elevator shaft. The first shaft unit can consequently include multiple elevator shafts. An expedient number of cars consequently run inside the individual elevator shafts of the first shaft unit.

At least one shaft-changing multi-car system is provided in the second shaft unit. The second shaft unit includes, in particular, at least two elevator shafts. At least one shaft-changing multi-car system, in this case, runs in said at least two elevator shafts. A shaft-changing multi-car system, in this case, includes, in particular, at least two cars in at least two elevator shafts. Said at least two cars, in this case, can change expediently between the at least two elevator shafts. The cars of a shaft-changing multi-car system, in this case, are not fixedly connected to an elevator shaft, as is the case with single-car systems and multi-car systems.

In particular, the cars of a shaft-changing multi-car system are able to change between the elevator shafts at an upper and/or at a lower end of the elevator shafts. Even the cars changing between the elevator shafts on other expedient storeys, for example in the region of the shaft center, is conceivable. If the shaft-changing multi-car system includes more than two elevator shafts, the individual cars of the shaft-changing multi-car system are able to change in particular between all of said elevator shafts. Cars changing between elevator shafts in this manner can only be carried out, in this case, for example, between adjacent elevator shafts, or in particular also in a flexible manner between non-adjacent elevator shafts.

According to the invention, for the case where a transporting operation, that is to say conveying one passenger or multiple passengers, is to be carried out from an initial storey to a destination storey, a decision is made as to which car or cars is/are to be used to carry out the transporting operation. In this case, the decision is made as to whether the transporting operation is to be carried out by using one or several cars of the at least one single car system, one or several cars of the at least one multi-car system, one or several cars of the at least one shaft-changing multi-car system or a combination of the same.

In particular, the elevator system according to the invention includes a control unit which is capable, by using a suitable calculation model, of calculating an optimum transporting operation by taking respective cars into consideration. A control unit of this type is realized in an expedient manner with a destination control unit or destination selection control means which is actuatable by the persons to be conveyed.

According to the invention, an assessment is consequently made as to which cars of the individual car systems of the elevator system are utilized for the transporting operation. Changing of the cars of two car systems is effected, in this case, at expedient transfer levels or transfer stops or changeover stops. In particular, said transfer stops serve for transporting operations to higher storeys. The transfer stops offer additional degrees of freedom for possible combination or combinatorics of the individual cars of the different car systems for the transporting operation. The transfer stops consequently form a variable for the assessment or decision according to the invention as to which car(s) of the different car systems are utilized for the transporting operation.

All of the car systems of the first and of the second shaft unit are taken into consideration, in this case, for the assessment. The assessment is not carried out for the different car systems of the first and of the second shaft units separately and independently of one another. The elevator system is considered as one unit for the assessment. In particular, a combination of all the car systems of the elevator system is consequently considered for the assessment.

The elevator system is consequently not operated merely as a stringing together of the individual car systems. The individual car systems of the elevator system are consequently not operated independently of one another. According to the invention, the individual car systems are consequently combined together in the best possible manner.

The individual car systems are consequently cross-linked with one another. In particular, in this case, all the cars of the individual car systems are cross-linked together. In order to assess which car or which cars will be utilized for the transporting operation, all the cars of the individual car systems are consequently considered. In particular, the transfer stops, at which passengers are able to change between cars of individual car systems, enable this type of cross-linking or combination of the individual car systems.

According to the invention, an assessment is consequently made as to with which combination of the individual car systems or with which combination of the individual cars of the individual car systems the transporting operation is able to be carried out in the quickest possible or best possible manner. The individual car systems, in this case, can be combined with one another by means of the transfer stops.

The advantages of the individual car systems are exploited and the disadvantages or weaknesses thereof can be minimized or eliminated as a result of the invention. The individual car systems, separately per se, are nowadays almost no longer able to meet the high requirements in buildings or high rise buildings with multiple storeys. This is, however, made possible as a result of the combination or cross-linking according to the invention of single-car systems, multi-car systems and shaft-changing multi-car systems.

An effective, efficient use of individual car systems depends greatly on the combination or combinatorics with other car systems. The invention provides an effective combination between a shaft-changing multi-car system and single-car and/or multi-car systems. In this case, the advantages of the individual car systems can also be combined in an optimized manner or maximized. In particular, a shaft-changing multi-car system has the advantage of a high handling capacity (HC), that is to say a high transporting capacity. Said advantage can, however, in particular only be exploited optimally if the shaft-changing multi-car system has to cover as few intermediate stops as possible. As the invention makes it possible to carry out transporting operations with as few transfers as possible and consequently with as few intermediate stops as possible, said advantages of the shaft-changing multi-car system can be utilized in an optimum manner.

The invention is suitable, in this case, in particular, for elevator systems in buildings with a building height or a vertical length of up to 1000 m. A handling capacity for the transporting of passengers can be optimized by means of the elevator system according to the invention. In addition, in this case, a cross-sectional area of the vertical transporting system is able to be minimized. The floor area and space requirement of the elevator system according to the invention, in this case, is able to be kept as small as possible in order to optimize the handling capacity.

The transporting operations are able to be optimized as a result of the combination or cross-linking according to the invention of the individual car systems and of the assessment according to the invention as to which of the cars of the individual car systems are used for a transporting operation. In particular, the transporting operations, in this case, can be carried out as quickly as possible and in a time-optimized manner, with a minimum time for a user until reaching the destination storey. In addition, short waiting times are produced in this case. In particular, a waiting time for a car of the elevator system at the initial storey is able to be kept as short as possible in this case. In addition, the transporting operation is carried out with the individual cars having a minimum number of intermediate stops. In particular, the transporting operation can be carried out with a transfer or a changeover or a change in cars. Said necessary transfers are, however, reduced to a minimum as a result of the assessment according to the invention. The elevator system consequently comprises an objectively and/or subjectively optimized transporting behavior.

The cross-linking of the individual car systems or the assessment according to the invention are carried out, in particular, by an expedient cross-linking control means which is realized, for example, on an expedient control instrument or an expedient control unit. The elevator system according to the invention can also be operated, however, without said cross-linking or combination of the individual car systems, for example if said cross-linking control breaks down. In this case, the individual car systems are also able to be operated independently from one another and not cross-linked to one another. The assessment, in this case, can take the individual car systems per se into consideration and not the combination or cross-linking thereof.

During peak times, so-called up-peaks can occur in particular (large number of transporting operations to higher storeys). In addition, so-called lunch traffic can occur at peak times. In this case, there is a large number of transporting operations in both directions, that is to say both to lower storeys and to higher storeys. Said peak times are able to be managed in an optimum manner as a result of the combination or cross-linking of the car systems according to the invention and the corresponding assessment.

In the course of the assessment, consideration is given in particular to the fact that as few cars as possible are involved in one transporting operation and that the transporting operation is carried out as quickly as possible. This is not only advantageous for a user who would like to be transported to a storey during a transporting operation, but an energy balance of the elevator system can also be optimized as a result. Moving as few cars as possible in the course of a transporting operation reduces the energy required to operate the elevator system. Energy demand and energy provision can consequently be balanced out in an optimum manner and an optimum energy balance is able to be achieved.

The dividing of elevator shafts according to the invention into a first and a second shaft unit, as well as the use according to the invention of single-car or multi-car systems on the one hand and shaft-changing multi-car systems on the other hand, can be viewed as a basic configuration which is able to be adapted in a flexible manner depending on the height of a corresponding building. Correspondingly, the basic configuration can also be adapted in dependence on the population of the corresponding building or on the traffic flow, that is to say on the (average) number of transporting operations.

According to conventional elevator systems, double-decker car systems with in each case two fixedly interconnected cars are often utilized. However, these comprise enormous disadvantages. In contrast thereto, enormous advantages are produced by the use of cars of a shaft-changing multi-car system. Whilst cars of a double-decker car system comprise a comparatively large weight and are not able to be moved flexibly and independently of one another, the cars of the shaft-changing multi-car system are able to be moved on their own, individually and independently of one another. As a result of the possibility of changing flexibly between elevator shafts, a further degree of freedom is produced for the assessment.

Enormous advantages compared to double-decker car systems are also produced as a result of using single-car and multi-car systems. In particular, in this case, the advantage of multi-car systems compared to double-decker car systems is that they operate several cars which are able to be moved flexibly in different directions.

Over and above this, double-decker car systems in the majority of cases require double-decker entrance levels. No such double-decker entrance levels are required as a result of the combination of car systems according to the invention. These types of double-decker entrance levels also require in the majority of cases escalators or moving staircases for an upper entrance level of the double entrance levels, as a result of which further expenditure is created. Nevertheless, the use of double entrance levels is also possible for the invention.

In an advantageous development of the invention, the first and the second shaft units are each divided into vertical intervals. Each of said individual vertical intervals include or extend, in this case, over a certain or expedient number of storeys.

In particular, the two shaft units are divided analogously into said same vertical intervals. In particular, in this case, the vertical length of a building, in which the elevator system according to the invention is installed, can be divided in each case into equal, equidistant, vertical intervals. In addition, in particular, the individual vertical intervals can also each include a different, expedient number of storeys.

One or several of the single-car systems can be provided in each case in individual vertical intervals of said vertical intervals of the first shaft unit. In particular, in this case, an elevator shaft is provided in the respective vertical interval for each single-car system. In such a single-car system, a car is movable in said elevator shaft of the vertical interval.

In addition, a common multi-car system can also be provided in several of the vertical intervals. Said vertical intervals, in this case, are in particular vertically adjacent intervals. In particular, in this case, an elevator shaft extends over said corresponding vertical intervals. The cars of said multi-car system, in this case, are movable independently over the corresponding vertical intervals in said elevator shaft. In particular, in this case, in each case one car of said multi-car system is moved inside one of said vertical intervals. In particular, in each case one car of said multi-car system consequently runs in each of said vertical intervals.

It is also conceivable for a multi-car system to be provided in a vertical interval or for a multi-car system to run in each case in individual vertical intervals of the vertical intervals of the first shaft unit. Each of said corresponding vertical intervals includes, in particular, an elevator shaft, in which several cars of the respective multi-car system are movable independently.

Consequently, in each case at least one single-car system and/or at least part of a multi-car system is provided in each vertical interval of the first shaft unit. Several car systems can also be provided in one vertical interval. For example, a first vertical interval can include a first elevator shaft, in which one single-car system is present. In addition, said first vertical interval can include a second elevator shaft which is not restricted to said first vertical interval and also extends over a second vertical interval which is located above said first vertical interval. A multi-car system can be present, for example, in said second elevator shaft and consequently in the first and second vertical interval.

The first shaft unit can consequently include multiple single-car and/or multi-car systems. In addition, the first shaft unit can consequently include multiple elevator shafts. Individual elevator shafts, in this case, can only extend inside a vertical interval or also over several vertically adjacent vertical intervals. An expedient number of cars consequently run inside the individual elevator shafts of the first shaft unit. Each of said cars, in this case, runs only inside the specific vertical interval or between the storeys of said specific vertical interval in which the corresponding single-car system or multi-car system is provided.

The elevator shafts of the individual vertical intervals of the first shaft unit, in this case, do not extend in particular over the entire vertical length of the building, but only over the vertical length of the respective interval or of the respective intervals. The individual elevator shafts of the vertical intervals, in this case, are in particular separated from one another or delimited by material physical barriers. Each elevator shaft of the vertical intervals has, in particular, a dedicated machine room for the respective single-car or multi-car systems. In addition, in particular, realizations of the single-car or multi-car systems without machine rooms are also conceivable.

As an alternative to this, however, elevator shafts of adjacent vertical intervals which are located consecutively one above another can also not be separated by a material physical barrier and can be connected together. For example, a shaft is also able to extend over the entire vertical length of the building. Individual (consecutive) storeys, in this case, are expediently divided into the individual vertical intervals or are assembled to form the same. Said elevator shaft is consequently divided into an expedient number of vertical intervals and consequently into an expedient number of smaller elevator shafts.

It is not possible, in this case, in particular, for one car to move over the entire length of the building in one of the elevator shafts of the first shaft unit. Each car is only able to move, in particular, inside the corresponding vertical intervals in which the respective single-car or multi-car system is provided.

The shaft-changing multi-car system or systems in the second shaft unit extend in particular over several of the vertical intervals, in particular over all of the vertical intervals. This means, in particular, that cars of a shaft-changing multi-car system can stop at all the storeys.

In particular, the cars of a shaft-changing multi-car system are able to change between the elevator shafts at an upper and/or at a lower end of the elevator shafts. The cars change between the elevator shafts in particular in at least one of the vertical intervals, in addition in particular between two vertical intervals arranged one above the other. Two vertical intervals arranged one above the other is to be understood, in this case, as two vertical intervals that are adjacent in the vertical direction.

The cars of two car systems are changed at the transfer stops. Transfer stops are, in particular, storeys where vertical intervals which are adjacent one above another adjoin one another. In particular, said transfer stops serve for transporting operations to higher storeys. Transfer stops, where two vertical intervals which are arranged one above the other adjoin, consequently form, in particular, entry opportunities for the car system of the respective upper vertical interval of said two vertical intervals.

In an advantageous manner, the cars of the at least one shaft-changing multi-car system can run over the entire vertical length of the second shaft unit. In particular, the cars of the at least one shaft-changing multi-car system are movable over the entire vertical length of the respective elevator shafts of the second shaft unit. In particular, the elevator shafts of the second shaft unit, in this case, can extend over the entire vertical length of the building. As explained, the cars of the single-car systems and of the multi-car systems run in particular only inside certain vertical intervals of the first shaft unit. Where there are several shaft-changing multi-car systems, each shaft-changing multi-car system can also only extend over part (in particular a different, individual part) of the vertical length of the building or of the elevator shaft and consequently over certain vertical intervals.

At least two vertical intervals which are arranged one above the other (that is to say two vertical intervals which are adjacent in the vertical direction) preferably form a multi-car system. A common elevator shaft, in this case, extends over said two vertical intervals. In particular, said multi-car system is a two-car system in which two cars are moved independently of one another. An upper car of the multi-car system, in this case, is moved in an upper vertical interval of said two vertical intervals and a lower car of the multi-car system is moved in a lower vertical interval of said two vertical intervals.

The storey, at which said two vertical intervals adjoin, serves, in this case, in particular, as a transfer stop or entry level for the upper car of the multi-car system. The lowermost storey of the lower vertical interval serves in particular as a transfer stop or entry level for the lower car of the multi-car system.

In a preferred development of the invention, the vertical intervals of the elevator shafts can overlap. This is to be understood as specific storeys making up two different vertical intervals. If two vertical intervals overlap, the cars of the respective two single-car or multi-car systems of said two overlapping vertical intervals are consequently able to stop at said overlapping storeys in the elevator shaft. The specific storeys, in which two vertical intervals overlap, can consequently be stopped at both by the car of the single-car or multi-car system of the one overlapping vertical interval, and by the car of the single-car or multi-car system of the other overlapping vertical interval. The cars of the single-car systems or of the multi-car systems nevertheless run only inside the respective vertical intervals. It can, however, be made possible as a result of the overlapping of vertical intervals that certain storeys are nevertheless able to be stopped at by several cars. The overlapping storeys consequently form overlapping transfer stops, at which passengers are able to enter both the car system of the upper vertical interval and the car system of the lower vertical interval. In particular, these types of overlapping transfer stops are provided for two single-car systems.

In an advantageous manner, the cars of the shaft-changing multi-car system of the second shaft unit are used as feeder cars in the course of a first part-transporting operation of the transporting operation. The transporting operation can consequently be divided into several part-transporting operations, in particular into two part-transporting operations. In the course of said first part-transporting operation, a comparatively large vertical distance or height or number of storeys is thus covered. The feeders consequently serve the purpose of covering a long distance. The cars of the shaft-changing multi-car system are consequently used as long distance cars. It is consequently possible to ensure that the cars of the shaft-changing multi-car system have to cover as few intermediate stops as possible. In particular, the cars of the shaft-changing multi-car system are used as feeder cars at transfer stops in the course of the first part-transporting operation. The feeder cars are thus moved in particular between the transfer stops. Passengers are consequently transported by means of the feeder cars to transfer stops at which the passengers are able to change for a further car system. In a preferred manner, said feeder cars run between individual vertical intervals in the course of the first part-transporting operation of the transporting operation.

In an advantageous manner, the cars of the single-car systems and multi-car systems of the first shaft unit are used as short distance cars in the course of a second part-transporting operation of the transporting operation. In this case, said short distance cars run in a preferred manner between storeys inside the respective vertical intervals of the corresponding single-car system or multi-car system in the course of the second part-transporting operation of the transporting operation. A comparatively small vertical distance or height or number of storeys is consequently covered in the course of said second part-transporting operation. The cars of the single-car system or of the multi-car system of the first shaft unit inside the individual vertical intervals are consequently realized in particular as local elevator groups.

The transporting operation can be optimized by means of said combination of feeder cars and short distance cars. Using the shaft-changing multi-car system as feeder cars (in particular to a transfer stop) for the first part-transporting operation and the single-car and multi-car systems as short distance cars for the second part-transporting operation is consequently a particularly preferred combination or cross-linking of the individual car systems. In the course of the first part-transporting operation, passengers are transported by means of the feeder cars consequently in particular to transfer stops where the passengers change for one of the short distance cars. Said use of the individual cars as feeder cars and short distance cars or a corresponding number of admissible storeys between which the individual feeder cars and short distance cars run, is, in this case, in particular, taken into consideration in the assessment according to the invention.

For example, when a transporting operation is to be carried out from the ground level or from the lowermost storey to a higher destination storey, first of all said first part-transporting operation can be carried out by means of a feeder car to the vertical interval in which the destination storey is located. A changeover can be made from the feeder car into a short distance car at the corresponding transfer stop. The second part-transporting operation can then be carried out inside said vertical interval to the corresponding destination storey by means of said short distance car.

In a preferred manner, storeys where vertical intervals adjoin one another are used as transfer stops or changeover options between cars of one of the single-car systems, of the multi-car systems and/or of the shaft-changing multi-car systems. In the course of the transporting operation, a change can consequently be made at said corresponding storeys between a single-car system, a multi-car system and/or a shaft-changing multi-car system. In particular, when the two shaft units are divided analogously into said same vertical intervals, said storeys, which adjoin at two vertical intervals, form flexible transfer stops between the various adjoining car systems.

Said transfer stops are consequently transfer options for the transporting operation. In particular, a change of cars between individual part-transporting operations takes place at said transfer stops. The transfer stops, in this case, are in particular feeder stops. In addition, a change from a feeder car of the first part transport to a short distance car of the second part transport takes place in particular at said transfer stops.

However, storeys inside individual vertical intervals can also be chosen as transfer stops. In particular, the transfer stops can be chosen in a flexible manner, even during the regular operation of the elevator system. The transfer stops are consequently not fixedly and obligatorily predetermined, but can be chosen flexibly, adapted to the current traffic flow or the current number of transporting operations. In particular, it is possible to choose which storeys are utilized as transfer stops in the course of the assessment according to the invention.

When at least two shaft-changing multi-car systems are operated in the second shaft unit and, at the same time, cars of at least two shaft-changing multi-car systems are utilized as feeder cars, the individual transfer stops can be divided among all said feeder cars. Consequently, unnecessary stops of individual cars are avoided.

The transfer stops are preferably provided in each case at vertical distances of between 20 m and 100 m. The transfer stops can be arranged, in this case, in particular in such a manner in (in particular equidistant) vertical distances which are optimum in order to handle the up-peak (large number of transporting operations to higher storeys) at peak times. In particular, the transfer stops are provided at vertical distances in such a manner that an optimum dispatch algorithm is able to be carried out in the course of the assessment according to the invention.

In a preferred manner, the shaft units are divided into between two and five vertical intervals per 100 m building height. In particular, in this case, both shaft units are divided into the same vertical intervals. As a result of said division into between two and five vertical intervals per 100 m building height, an optimum dispatch algorithm is able to be carried out in the course of the assessment according to the invention. This consequently ensures that traffic of cars moving in the shaft units is with minimized delay.

The elevator system is preferably operated without destination selection control (DSC) or without call control. In particular, if the cars of the multi-car system are used (exclusively) as feeder cars, destination selection control can be dispensed with. In this case, the individual vertical intervals can be realized in particular with direction-sensitive collection control. Cross-linking the individual car systems ensures, in particular, that a car is always made available immediately at the changeover options. As an alternative to this, it is nevertheless possible to implement destination selection control or call control in the elevator system.

In particular, the shaft-changing multi-car system is operated without call control. The cars of the shaft-changing multi-car system, in this case, are in particular moved permanently between the transfer stops, irrespective of call control. In said case, passengers are able to enter an arbitrary car of the shaft-changing multi-car system, which is available at the initial storey, in order to start their transporting operation. The passenger then gets out independently at the corresponding transfer stop and changes to one of the short distance cars in order to arrive at the destination storey. As an alternative to this, it is nevertheless possible to operate the shaft-changing multi-car system with call control.

In an advantageous development of the invention, the cars of the shaft-changing multi-car system or the cars of each shaft-changing multi-car system are in each case synchronized. In this case, in particular starts or departures and arrivals of the individual cars of the shaft-changing multi-car system are synchronized, that is to say are matched to one another. In particular, the departures and arrivals at the individual transfer stops are synchronized. Consequently, traffic jams are avoided and an optimum number of cars of the shaft-changing multi-car system can be operated. In particular, the travel curves of the individual cars can be individually adapted as a result of the synchronization. Consequently, long downtimes and separate stops produced by waiting for other cars are avoided or reduced.

In the course of the synchronization, in this case, in particular cars of the shaft-changing multi-car system which run in opposite directions can be considered and matched to one another. In particular, in this case, the journeys of cars travelling in opposite directions can be matched to one another such that the cars moving in opposite directions move at substantially the same time. A first downward moving car of the shaft-changing multi-car system, in this case, can be seen as a "virtual" counterweight to a second downward moving car of the shaft-changing multi-car system. Consequently, energy management of the elevator system can be further optimized. It is possible, as a result of the downward movement of the first car, to gain energy which is utilized (instantaneously) for the upward movement of the second car. Consequently, in particular, a connected load of the elevator system is able to be optimized.

In a preferred manner, information relating to the transporting operation is output by means of a display device. This type of information can include, in particular, car departure or arrival times utilized for the transporting operation. In particular, the information can include delay times by which, for example, the departure of a car is delayed. Such delay times can occur, for example, when cars of the shaft-changing multi-car system are synchronized. In this case, it can sometimes be the case that passengers are still getting into one of the cars, whilst another car, which serves as virtual counterweight, is ready to depart. An information system for arrivals and departures is provided, in particular, by a display device of this type.

These types of display devices can be realized, for example, visually and/or acoustically. In particular, this type of display device is realized as a monitor which is arranged in the individual cars and/or outside the cars. For example, a display device of this type can also be arranged at the individual transfer stops.

In an advantageous manner, the transporting operation is carried out in the course of a direct journey, in particular outside definable peak times, by means of a car of the shaft-changing multi-car system. In the course of a direct journey, exclusively the corresponding car carries out the transporting operation from the starting storey to the destination storey. Consequently, multiple cars (in particular a feeder car and a short distance car) must not be unnecessarily operated in particular outside the peak times when there is no great traffic flow. The energy required to operate the elevator system can consequently, for example, be reduced outside the peak times.

In a preferred manner, the number of cars of the shaft-changing multi-car system can be modified. In particular, the number can be modified or adapted in dependence on the number of transporting operations or in dependence on the actual or anticipated traffic flow. In this case, individual cars can be removed (temporarily) from the shaft-changing multi-car system. Said removed cars can be stored in particular in a garage or in a storage space. In particular, an assessment can be made in the course of the assessment according to the invention as to whether and how many cars are to be removed from the shaft-changing multi-car system. Said assessment, in this case, can be carried out in particular in an intelligent, self-learning and proactive manner.

According to an advantageous embodiment of the invention, a decision is made, with consideration to pre-selectable criteria and/or to parameters which are predefinable and/or detected currently or in a predefinable time window, as to which car or cars is/are to be used to carry out the transporting operation. In particular, the control unit of the elevator system is capable of calculating an optimum transporting operation with consideration to respective cars on the basis of input pre-selectable criteria and/or of predefinable and/or detected parameters by using a suitable calculation model. A control unit of this type is expediently realized with a destination control unit or destination selection control which is actuatable by the persons to be conveyed.

In a preferred manner, the decision as to with which car or with which cars the transporting operation is to be carried out is made in consideration of the following criteria or parameters: the destination storey of a passenger, the destination storeys of multiple passengers, a current traffic density, an energy demand and/or an availability of individual cars. In particular, various traffic routes or options for carrying out the transporting operation can be calculated by way of said criteria or parameters. Said various traffic routes can consider both direct routes and also combinations of cars of the various car systems. The best possible or the most favorable of said traffic routes is selected by way of the named criteria or parameters.

Those having ordinary skill in the art will understand that the features identified above and those yet to be explained below are usable not only in the context and/or combination provided in each example, but may also be used in other contexts and/or other combinations or standing alone without departing from the scope of the present disclosure. Likewise, those having ordinary skill in the art will understand that the term 'storey' may be used interchangeably herein with the term 'floor.' Still further, those having ordinary skill in the art will understand that reciting 'a' element or 'an' element in a claim does not restrict that claim to articles, apparatuses, systems, methods, or the like having only one of that element.

FIG. 1 shows a schematic representation of a preferred development of an elevator system according to the invention in a building, said elevator system being given the reference 100. The elevator system 100, in this case, comprises a first shaft unit 110 and a second shaft unit 120.

The shaft units are divided into five vertical intervals I1, I2, I3, I4, I5. A certain number of storeys, in this case, are assembled to form in each case one of the vertical intervals. All five vertical intervals I1, I2, I3, I4, I5 are of the same vertical height in said example. All five vertical intervals I1, I2, I3, I4, I5 additionally include the same number of storeys in said example. The vertical intervals can also each comprise a different expedient number of storeys or vertical height.

The building in which the elevator system 100 is installed is to comprise a building height of 100 m purely as an example. Each vertical interval consequently extends in said example over 20 m building height. The building includes 25 storeys as an example. Each vertical interval consequently extends over 5 storeys. Storeys at which in each case two vertical intervals adjoin one another are provided as transfer stops or changeover options H1, H2, H3, H4. An entry point H0, in this case, is arranged in particular on a ground level.

As an example, the second shaft unit 120 comprises four elevator shafts 121, 122, 123, 124 here. A shaft-changing multi-car system is implemented in said four elevator shafts 121, 122, 123, 124 of the second shaft unit 120. Said shaft-changing multi-car system includes in particular 20 cars which are able to change flexibly between the four shafts 121, 122, 123, 124 of the second shaft unit 120.

The first shaft unit 110 comprises four elevator shafts 111*a*, 112*a*, 113*a* and 114*a* inside the first interval I1. The first shaft unit 110 comprises a further four elevator shafts 111*b*, 112*b*, 113*b* and 114*b* inside the second and third intervals I2 and I3. The first shaft unit 110 comprises a further four elevator shafts 111*c*, 112*c*, 113*c* and 114*c* inside the fourth and fifth intervals I4 and I5. Said elevator shafts of the various vertical intervals are separated from one another in particular by means of vertical physical barriers (e.g. concrete slabs) and in each case have in particular a dedicated machine room.

One car of a single-car system runs inside the vertical interval I1 in each of the four shafts 111*a*, 112*a*, 113*a*, 114*a* of the first shaft unit 110. Consequently, a total of five cars run between the entry point H0 and the changeover option H1. Said cars are not shown in detail for reasons of clarity.

Two cars, which can be moved independently of one another, of a respective multi-car system run each of the four shafts 111*b*, 112*b*, 113*b*, 114*b* of the vertical intervals I2 and I3 of the first shaft unit 110. Said multi-car systems, in this case, are each developed as two-car systems. A lower car of the respective multi-car system runs, in this case, inside each of the four shafts 111*b*, 112*b*, 113*b*, 114*b* of the second vertical interval I2. An upper car of the respective multi-car system runs, in this case, inside each of the four shafts 111*b*, 112*b*, 113*b*, 114*b* of the third vertical interval I3.

The transfer stop H1 serves in this case in particular as an entry possibility for said lower cars of the respective multi-car system. The transfer stop H2 serves in particular as an entry possibility for said upper cars of the respective multi-car system.

In an analogous manner, a lower or an upper car of a respective multi-car system runs in each of the four shafts 111*c*, 112*c*, 113*c*, 114*c* of the vertical intervals I4 or I5 of the first shaft unit 110.

The transfer stops H3 or H4 serve in an analogous manner in particular as an entry possibility for the lower or upper cars of the respective multi-car system.

If a transporting operation is to be carried out, an assessment is made as to which of the individual cars of the single-car system, of the multi-car systems and of the shaft-changing multi-car system will be used for said transporting operation.

An example is described below in which four transporting operations are to be carried out from the ground level H0 to four different destination storeys. A first transporting operation is to be carried out to the fourth storey S4. A second transporting operation is to be carried out to the $10^{th}$ storey S10 which provides the second transfer stop H2. A third transporting operation is to be carried out to the $17^{th}$ storey S17. A fourth transporting operation is to be carried out to the $22^{nd}$ storey S22.

A decision is made as to which cars are used for the individual transporting operations with regard to said four different destination storeys, to the availability of individual cars, to the current traffic density and to the required energy demand.

In this case, the first transporting operation to the fourth storey S4 is carried out as a direct journey by means of the car of the single-car system in the elevator shaft 111*a* of the first shaft unit 110.

The second transporting operation to the $10^{th}$ storey S10 is carried out as a direct journey by means of a car of the shaft-changing multi-car system in the elevator shaft 121 of the second shaft unit 120.

The third transporting operation to the $17^{th}$ storey S17 is carried out in two part-transporting operations. In this case, initially a first part-transporting operation is carried out from the ground level to the transfer stop H3. Said first part-transporting operation is carried out as a feeder journey by means of a car of the shaft-changing multi-car system in the elevator shaft 123 of the second shaft unit 120. A second part-transporting operation is then carried out from the transfer stop H3 to the storey S17. Said second part-transporting operation is carried out with the lower car of the multi-car system in the elevator shaft 114*c* of the vertical interval I4.

The fourth transporting operation to the $22^{nd}$ storey S22 is also carried out in two part-transporting operations. In this case, initially a first part-transporting operation is carried out from the ground level to the transfer stop H4. Said first part-transporting operation is carried out as a feeder journey by means of the car of the shaft-changing multi-car system in the elevator shaft 121 of the second shaft unit 120. Said car has to make an intermediate stop in this case at the transfer stop H2 in order to carry out the second transporting operation. The car then moves further to the transfer stop H4. A second part-transporting operation is then carried out from the transfer stop H4 to the storey S22. Said second part-transporting operation is carried out with the upper car of the multi-car system in the elevator shaft 113*c* of the vertical interval I5.

Figure 2:
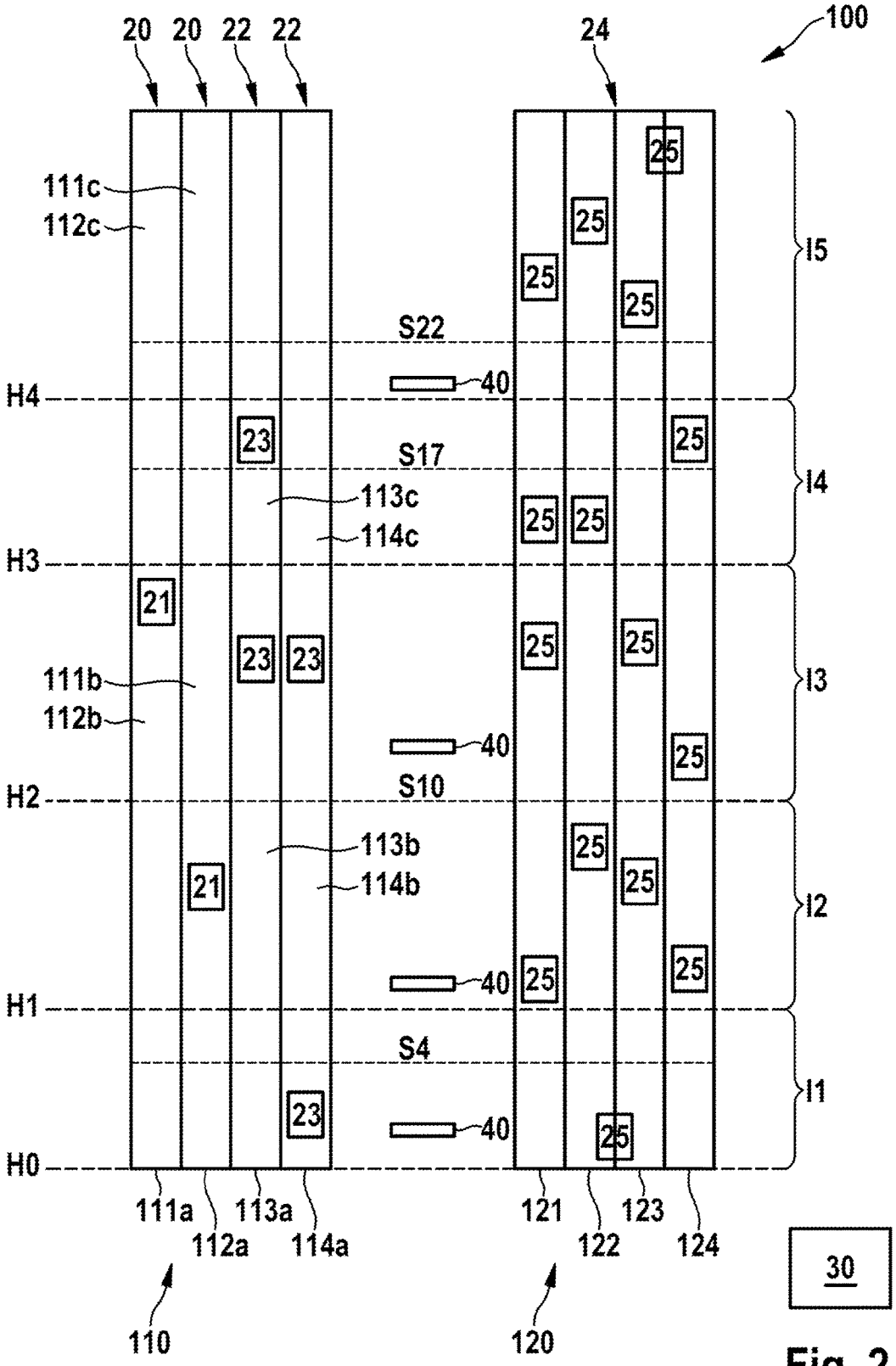
FIG. 2 is another schematic view of an example elevator lift system in a building.

As disclosed above and as shown in FIG. 2, in some examples the lift system 100 may include a first shaft unit 110 that includes a plurality of lift shafts 111*a*, 112*a*, 113*a*, 114*a*, at least one of a single-car system 20 or a multi-car system 22 disposed in the first shaft unit 110, a second shaft unit 120 that includes a plurality of lift shafts 121, 122, 123, 124, and a shaft-changing multi-car system 24 disposed in the second shaft unit 120. As also disclosed above, the first shaft unit 110 may include more than one single-car system 20 and/or more than one multi-car system 22. FIG. 2 illustrates an elevator car 21 in each of the single-car systems 20, and elevator cars 23 in each of the multi-car systems 22. Likewise, FIG. 2 illustrates various elevator cars 25 of the shaft-changing multi-car system 24 in the second shaft unit 120. Still further, the example lift system 100 shown in FIG. 2 may include a control unit 30 that determines whether to transport passengers to destination floors using the single-car systems 20, the multi-car systems 22, the shaft-changing multi-car system 24, or a combination thereof depending on the destination floors of the passengers, traffic density, energy demand, and/or availability of cars, for instance. The lift system 100 may also include display devices 40 disposed outside of and/or within the cars. The display device 40 may visually and/or acoustically display information relating to transportation operations, for example.

What is claimed is:

1. A lift system comprising:

a first shaft unit that includes a plurality of lift shafts;

at least one of a single-car system or a multi-car system disposed in the first shaft unit;

a second shaft unit that includes a plurality of lift shafts;

a shaft-changing multi-car system disposed in the second shaft unit; and a control unit that determines whether to transport passengers to destination floors using the single-car system, the multi-car system, the shaft-changing multi-car system, or a combination thereof depending on at least one of the destination floors of the passengers, traffic density, energy demand, or availability of cars.

2. The lift system of claim 1 wherein the cars of the shaft-changing multi-car system move over an entire vertical length of the second shaft unit.

3. The lift system of claim 1 further comprising at least one of a plurality of single-car systems or a plurality of multi-car systems disposed in the first shaft, wherein the first and second shaft units are each divided into vertical intervals that each comprise a plurality of floors, with the vertical intervals being the same for the first and second shaft units, the lift system further comprising at least one of:

one or more of the single-car systems disposed in individual vertical intervals of the vertical intervals of the first shaft unit, or one or more of the multi-car systems disposed in a plurality of the vertical intervals of the first shaft unit.

4. The lift system of claim 1 wherein the first and second shaft units are each divided into vertical intervals that each comprise a plurality of floors, with the vertical intervals being the same for the first and second shaft units, wherein the multi-car system operates in an upper vertical interval and a lower vertical interval that are vertically adjacent to one another in the first shaft unit, wherein an upper car of the multi-car system operates in the upper vertical interval and a lower car of the multi-car system operates in the lower vertical interval.

5. The lift system of claim 1 wherein the first and second shaft units are each divided into vertical intervals that each comprise a plurality of floors, with the vertical intervals being the same for the first and second shaft units, wherein the vertical intervals partially overlap such that one or more floors within a lower vertical interval are also part of an upper vertical interval directly above the lower vertical interval.

6. The lift system of claim 5 further comprising a transfer stop located on a floor where the vertical intervals partially overlap, wherein a passenger can transfer between the shaft-changing multi-car system of the second shaft unit and the single-car system or the multi-car system of the first shaft unit at the transfer stop.

7. The lift system of claim 6 further comprising a plurality of transfer stops, wherein each of the plurality of transfer stops are spaced apart by between 20-100 meters.

8. The lift system of claim 1 wherein a number of cars of the shaft-changing multi-car system is modifiable depending on anticipated or actual transporting operations.

9. A lift system comprising:

a first shaft unit that includes a plurality of lift shafts;

a single-car system and a multi-car system disposed in the first shaft unit;

a second shaft unit that includes a plurality of lift shafts; and a shaft-changing multi-car system disposed in the second shaft unit.

10. The lift system of claim 9 wherein the lift system is operated without at least one of destination selection control or call control.

11. The lift system of claim 9 wherein the first and second shaft units are each divided into two, three, four, or five vertical intervals per 100 meters of building height, with each of the vertical intervals comprising a plurality of floors and with the vertical intervals being the same for the first and second shaft units.

12. A lift system comprising:

a first shaft unit that includes a plurality of lift shafts;

at least one of a single-car system or a multi-car system disposed in the first shaft unit;

a second shaft unit that includes a plurality of lift shafts; and a shaft-changing multi-car system disposed in the second shaft unit, wherein a car of the shaft-changing multi-car system of the second shaft unit is used as a feeder car in a first part-transporting operation where a passenger then changes cars prior to a second part-transporting operation that delivers the passenger to a destination floor.

13. The lift system of claim 12 wherein the feeder car moves between at least two vertical intervals during the first part-transporting operation.

14. The lift system of claim 12 wherein the second part-transporting operation is performed in the first shaft unit, wherein a vertical length traveled during the first part-transporting operation is greater than a vertical length traveled during the second part-transporting operation.

15. The lift system of claim 12 further comprising a display device for displaying information related to transportation operations of the lift system.

16. A lift system comprising:

a first shaft unit that includes a plurality of lift shafts;

at least one of a single-car system or a multi-car system disposed in the first shaft unit;

a second shaft unit that includes a plurality of lift shafts; and a shaft-changing multi-car system disposed in the second shaft unit, wherein the cars of the shaft-changing multi-car system are synchronized.

17. The lift system of claim 16 wherein outside definable time periods, the shaft-changing multi-car system transports a passenger by a direct journey to a destination floor.

18. A lift system comprising:

a first shaft unit including at least one lift shaft;

at least one of a single-car system or a multi-car system disposed in the first shaft unit;

a second shaft unit that includes a plurality of lift shafts;

a shaft-changing multi-car system disposed in the second shaft unit; and a control unit that determines whether to transport passengers to destination floors using the first shaft, the second shaft, or a combination thereof depending on at least one of the destination floors of the passengers, traffic density, energy demand, or availability of cars.

19. A method for operating a lift system having a first shaft unit and a second shaft unit, the method comprising:

transporting a passenger to a transfer stop by way of a shaft-changing multi-car system in the second shaft unit;

transporting the passenger from the transfer stop to a destination floor by way of a single-car system or a multi-car system in the first shaft unit; and synchronizing the cars of the shaft-changing multi-car system.

20. The method of claim 19 further comprising using a car of the shaft-changing multi-car system of the second shaft unit as a feeder car in a first part-transporting operation where a passenger then changes cars prior to a second part-transporting operation that delivers the passenger to a destination floor.

* * * * *